US010043454B2

(12) United States Patent
Nakagawa

(10) Patent No.: US 10,043,454 B2
(45) Date of Patent: Aug. 7, 2018

(54) SOURCE DRIVER CIRCUIT, AND DISPLAY DEVICE

(71) Applicant: JOLED INC., Tokyo (JP)

(72) Inventor: Hirofumi Nakagawa, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 15/509,674

(22) PCT Filed: Sep. 2, 2015

(86) PCT No.: PCT/JP2015/004465
§ 371 (c)(1),
(2) Date: Mar. 8, 2017

(87) PCT Pub. No.: WO2016/038855
PCT Pub. Date: Mar. 17, 2016

(65) Prior Publication Data

US 2017/0263185 A1 Sep. 14, 2017

(30) Foreign Application Priority Data

Sep. 12, 2014 (JP) ..... 2014-186892

(51) Int. Cl.
*G09G 3/32* (2016.01)
*G09G 3/3258* (2016.01)

(52) U.S. Cl.
CPC ... *G09G 3/3258* (2013.01); *G09G 2310/0289* (2013.01); *G09G 2310/0291* (2013.01); *G09G 2310/08* (2013.01)

(58) Field of Classification Search
CPC ..... G09G 3/3258; G09G 2310/08; G09G 2310/0291; G09G 2310/0289
See application file for complete search history.

(56) References Cited

U.S. PATENT DOCUMENTS

2002/0033786 A1 3/2002 Akimoto et al.
2003/0146923 A1 8/2003 Nakahira et al.
(Continued)

FOREIGN PATENT DOCUMENTS

JP 2000-098981 4/2000
JP 2002-041001 2/2002
(Continued)

OTHER PUBLICATIONS

International Search Report, dated Dec. 8, 2015 by the Japan Patent Office (JPO), in corresponding International Patent Application No. PCT/JP2015/004465.

*Primary Examiner* — Liliana Cerullo
(74) *Attorney, Agent, or Firm* — Greenblum & Bernstein, P.L.C.

(57) ABSTRACT

A source driver circuit is provided that supplies, to each of pixels arranged in a matrix, an electrical signal corresponding to a pixel signal. The source driver circuit includes a reference voltage generating unit, which includes a plurality of resistors connected in series, and a resistor, for gradation voltage generation that divides an input voltage into voltages of magnitudes. The source driver circuit also includes a gradation voltage generating circuit, which is connected between the plurality of resistors and is also connected between the plurality of resistors and the resistor for gradation voltage generation, that includes an offset-canceling amplifier. The offset-canceling amplifier alternates between an offset extraction state, in which an offset voltage of the offset-canceling amplifier is extracted, and a buffer output state, in which the offset voltage is added to the pixel signal and outputted.

5 Claims, 8 Drawing Sheets

(56) References Cited

U.S. PATENT DOCUMENTS

| | | | | |
|---|---|---|---|---|
| 2005/0007393 | A1 | 1/2005 | Akai et al. | |
| 2005/0012700 | A1 | 1/2005 | Hara | |
| 2006/0066548 | A1 | 3/2006 | Yoneyama et al. | |
| 2006/0098032 | A1 | 5/2006 | Nakahira et al. | |
| 2006/0244710 | A1 | 11/2006 | Iriguchi et al. | |
| 2009/0278868 | A1 | 11/2009 | Nakahira et al. | |
| 2011/0080214 | A1* | 4/2011 | Tsuchi | G09G 3/3688 330/69 |
| 2012/0069058 | A1 | 3/2012 | Ichikura | |
| 2012/0249607 | A1 | 10/2012 | Ichikura et al. | |
| 2015/0222252 | A1* | 8/2015 | Kim | H03K 5/003 327/307 |

FOREIGN PATENT DOCUMENTS

| | | |
|---|---|---|
| JP | 2003-337560 | 11/2003 |
| JP | 2004-354625 | 12/2004 |
| JP | 2005-010276 | 1/2005 |
| JP | 2005-316188 | 11/2005 |
| JP | 2006-099850 | 4/2006 |
| JP | 2006-308784 | 11/2006 |
| JP | 2007-334061 | 12/2007 |
| JP | 2012-068294 | 4/2012 |
| JP | 2012-212046 | 11/2012 |

* cited by examiner

SOURCE DRIVER CIRCUIT, AND DISPLAY DEVICE

TECHNICAL FIELD

The present disclosure relates to a source driver circuit and a display device.

BACKGROUND ART

In recent years, an active-matrix (hereinafter may be abbreviated as AM) display device has been developed which includes pixels each having a display element are arranged in a matrix. As an example, the display element is an organic electroluminescent (hereinafter may be referred to as EL or OLED) element.

In such a display device, for example, a voltage corresponding to a gradation (gradation voltage) is supplied to the display element. The gradation voltage is generated by dividing a supplied external voltage by a resistor (see Patent Literature (PTL) 1, for example).

PTL 1 discloses a technique for generating, by using a gamma resistor and a gamma-correction circuit, a gradation voltage corresponding to characteristics of a display device, and faithfully reproducing an image based on display data.

CITATION LIST

Patent Literature

[PTL 1] Japanese Unexamined Patent Application Publication No. 2005-10276

SUMMARY OF INVENTION

Technical Problem

Along with the increased image quality of display devices in recent years, the number of gradation voltages (number of bits) has increased. For example, in a display device including an organic EL element, the number of gradation voltages has increased from 8 bits to 12 bits in recent years.

In a case where the number of gradation voltages is increased while accuracy of a variation in voltage value in each gradation is maintained, the layout size of minimum unit resistors included in a resistor ladder and a voltage dividing resistance value cannot be changed. As a result, a total resistance value gets greater. Moreover, the circuit size of a voltage selector which selects any gradation voltage gets bigger if the number of gradation voltages is increased, and thus parasitic capacitance generated in the voltage selector increases.

With this, in a circuit which generates a gradation voltage, time constant determined by a gamma resistor and the parasitic capacitance increases, and it takes a long time for the gradation voltage to reach a predetermined value. Accordingly, in a case where the gradation voltage is outputted before the gradation voltage reaches the predetermined value, a problem arises in which a desired gradation is not displayed. In particular, the display device including the organic EL element easily shows a difference in luminance caused by gradation deviation, and has difficulty reproducing an image faithfully.

The present disclosure has been conceived in view of the above problem and is intended to provide a source driver circuit and a display device which make it possible to output a gradation voltage with high accuracy, at high speed, and with stability.

Solution to Problem

A source driver circuit according to the present disclosure is a source driver circuit which supplies, to each of pixels arranged in a matrix, an electrical signal corresponding to a pixel signal, the source driver circuit including: a reference voltage generating unit including a plurality of resistors connected in series; a resistor for gradation voltage generation which divides an input voltage into voltages of magnitudes; and a gradation voltage generating circuit which is connected between the plurality of resistors and between the plurality of resistors and the resistor for gradation voltage generation, and includes an offset-canceling amplifier, wherein the offset-canceling amplifier alternates between an offset extraction state in which an offset voltage of the offset-canceling amplifier is extracted and a buffer output state in which the offset voltage is added to the pixel signal and outputted.

Advantageous Effects of Invention

According to the present disclosure, it is possible to provide a source driver circuit and a display device which make it possible to output a gradation voltage with high accuracy, at high speed, and with stability.

DESCRIPTION OF EMBODIMENTS

Figure 1:
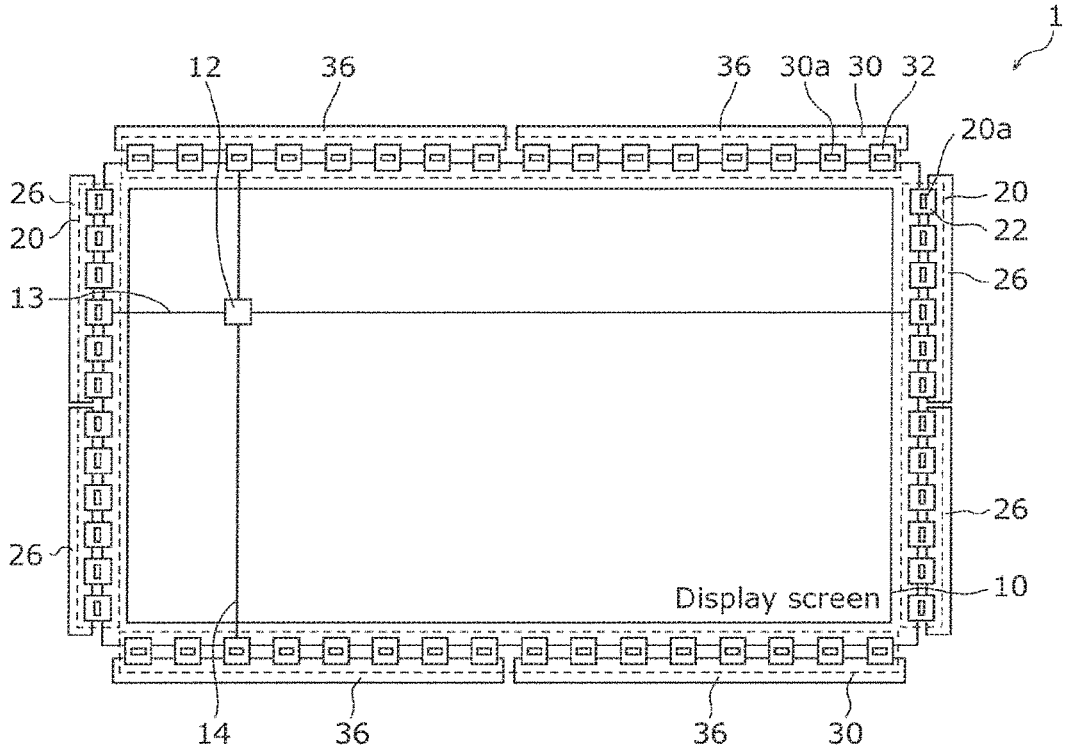
FIG. 1 is a schematic diagram illustrating a configuration of a display device according to an embodiment.

In order to solve the above problem, a source driver circuit according to an aspect of the present disclosure is a source driver circuit which supplies, to each of pixels arranged in a matrix, an electrical signal corresponding to a pixel signal, the source driver circuit including: a reference voltage generating unit including a plurality of resistors connected in series; a resistor for gradation voltage generation which divides an input voltage into voltages of magnitudes; and a gradation voltage generating circuit which is connected between the plurality of resistors and between the plurality of resistors and the resistor for gradation voltage generation, and includes an offset-canceling amplifier, wherein the offset-canceling amplifier alternates between an offset extraction state in which an offset voltage of the offset-canceling amplifier is extracted and a buffer output state in which the offset voltage is added to the pixel signal and outputted.

According to this configuration, the reference voltage generating unit is disposed in an input stage of the offset-canceling amplifier, and generates a reference voltage in a finely divided state and highly accurately. Moreover, after offset cancel, an output voltage of the offset-canceling amplifier is connected to the reference voltage generating unit for a video data period to generate a gradation voltage. After a certain period, the offset-canceling amplifier and the resistor for gradation voltage generation are disconnected. Accordingly, no switching noise occurs in the gradation voltage generating circuit and the resistor for gradation voltage generation when a gradation is switched, and the connection to the amplifier makes convergence easy. Consequently, it is possible to output the gradation voltage with high accuracy and stability.

Moreover, the offset-canceling amplifier may include an amplifier and an offset capacitor, wherein in the offset extraction state, an electrical charge corresponding to the offset voltage of the amplifier may be accumulated in the offset capacitor, and in the buffer output state, a voltage corresponding to the electrical charge accumulated in the offset capacitor may be added to the pixel signal and outputted.

According to this configuration, since switches are switched after the electrical charge corresponding to the offset voltage is temporarily accumulated in the offset capacitor, it is possible to output a gradation voltage with high accuracy and stability when the offset extraction state and the buffer output state are switched.

Moreover, the pixels each may include a light-emitting element, and the light-emitting element may be an organic electroluminescent (EL) element.

According to this configuration, it is possible to supply a stable current to the organic EL element.

Moreover, the offset-canceling amplifier may enter the offset extraction state in a blanking period after an end of a video data period in which video data is displayed on a display screen, and enter the buffer output state after the offset voltage is accumulated as the electrical charge in the offset capacitor in the blanking period.

According to this configuration, since the offset cancel is performed in the blanking period, the influence of the offset cancel never appears on the display screen. Consequently, it is possible to stably output a display image.

Moreover, a display device according to an aspect of the present disclosure includes the source driver circuit including the aforementioned features.

According to this configuration, it is possible to provide the display device including the source driver circuit including the aforementioned features.

Hereinafter, embodiments of the present invention will be described in detail with reference to the drawings. It is to be noted that the embodiments described below each represent a generic or specific example. The numerical values, shapes, materials, structural components, the arrangement and connection of the structural components, etc. shown in the following embodiments are mere examples, and are not intended to limit the scope of the present invention. Furthermore, among the structural components in the following embodiments, structural components not recited in any one of the independent claims are described as optional structural components. The Drawings are schematic drawings, and may not depict exact dimensions or dimensional ratios.

Embodiment (1. Configuration of Display Device)

Figure 2:
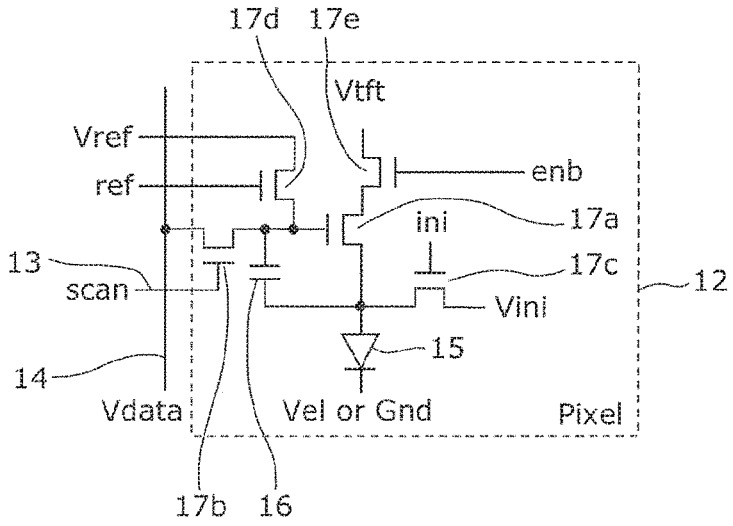
FIG. 2 is a circuit diagram illustrating a configuration of a pixel according to the embodiment.
Figure 3:
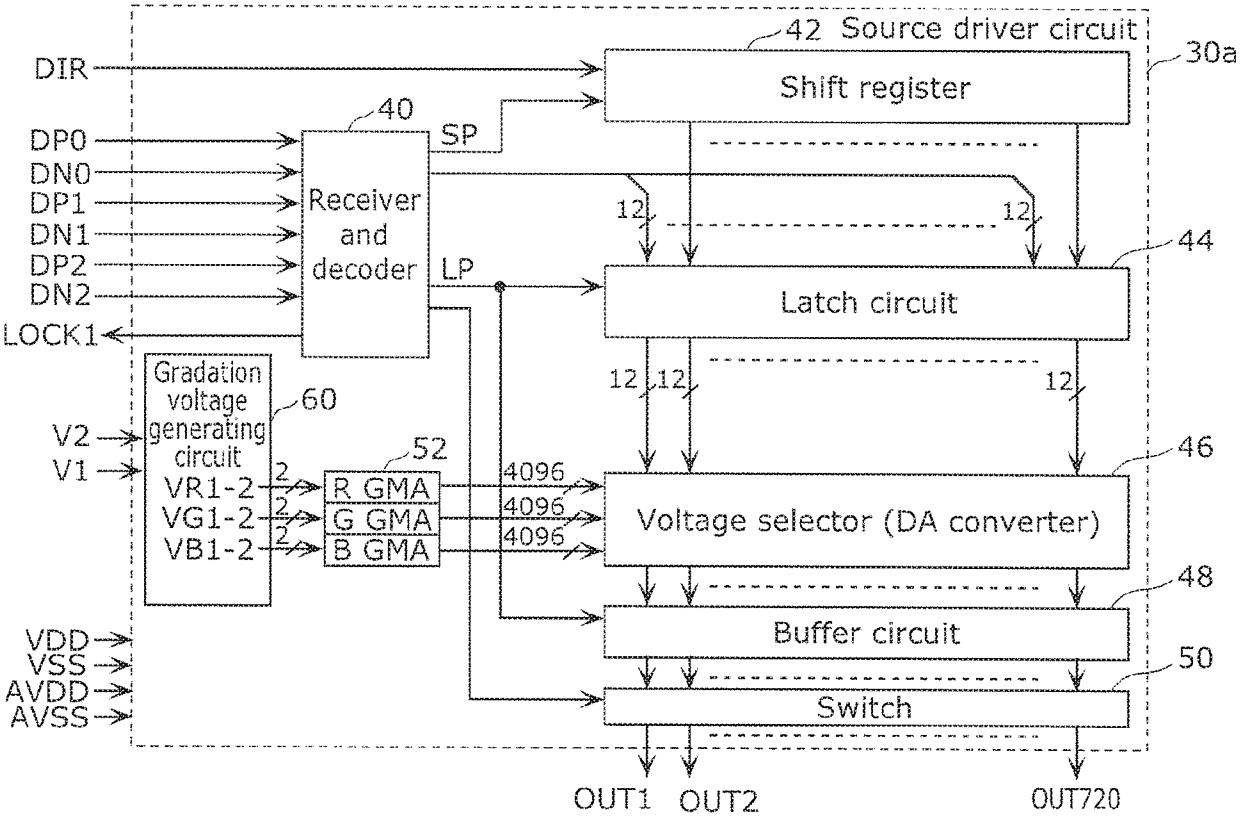
FIG. 3 is a block diagram illustrating a configuration of a source driver circuit according to the embodiment.
Figure 4:
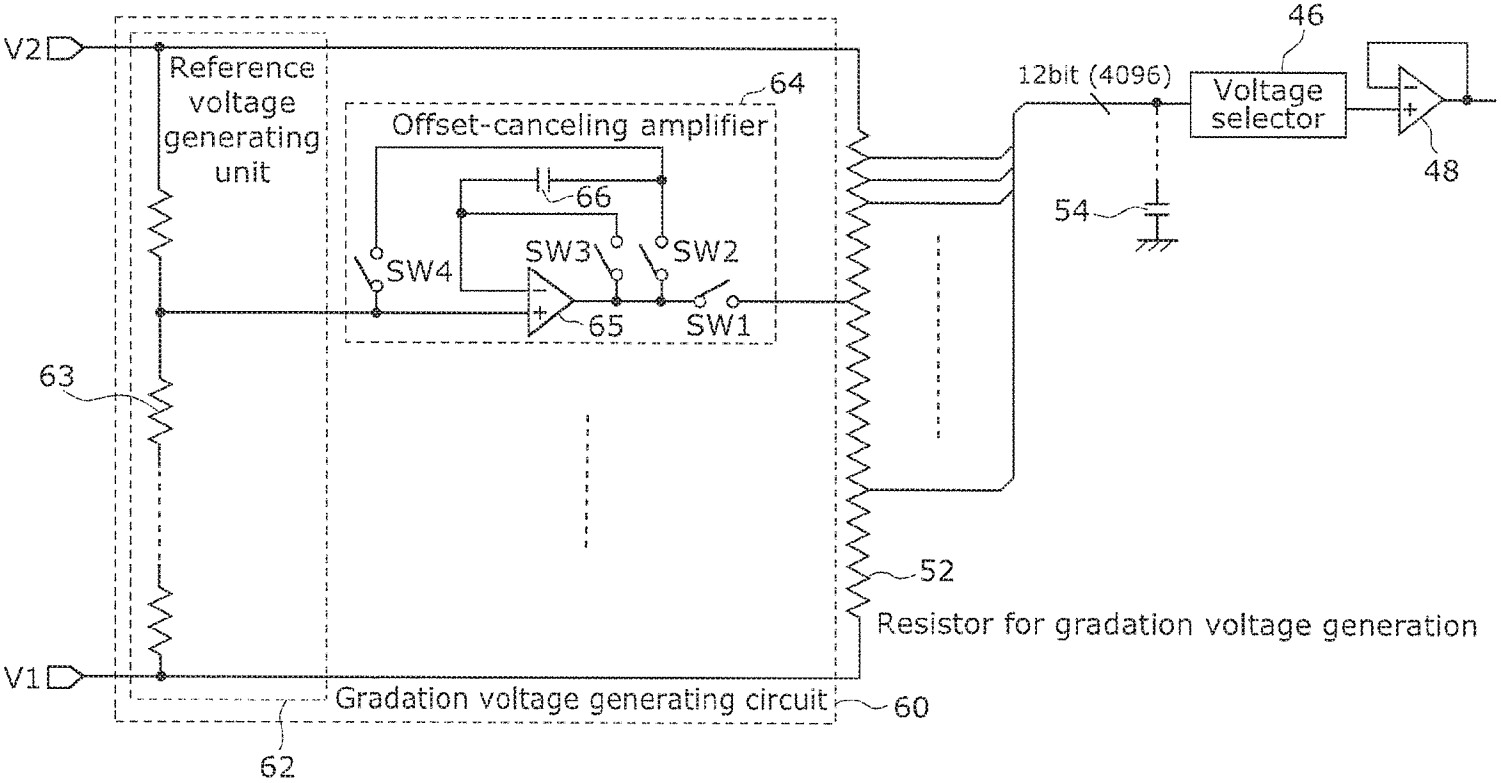
FIG. 4 is a schematic diagram illustrating a configuration of a gradation voltage generating circuit according to the embodiment.

FIG. 1 is a schematic diagram illustrating a configuration of a display device according to an embodiment. FIG. 2 is a circuit diagram illustrating a configuration of a pixel according to the embodiment. FIG. 3 is a block diagram illustrating a configuration of a source driver circuit according to the embodiment. FIG. 4 is a schematic diagram illustrating a configuration of a gradation voltage generating circuit according to the embodiment.

As illustrated in FIG. 1, a display device 1 includes: a display screen 10; chip on films (COFs) 22 on which circuits 20*a* are disposed; gate printed boards 26; COFs 32 on which circuits 30*a* are disposed; and source printed boards 36.

The circuits 20*a* disposed between the display screen 10 and the gate printed boards 26 are collectively referred to as a gate driver circuit 20. The COFs 22 on which the circuits 20*a* are disposed are disposed to connect the display screen 10 and the gate printed boards 26. The COFs 22 are connected to the display screen 10 and the gate printed boards 26 by an anisotropic conductive film (ACF) resin.

In the gate driver circuit 20, each circuit 20*a* is connected to a scanning line 13. The circuit 20*a* supplies a scanning signal scan to a pixel 12 via the scanning line 13.

Moreover, the circuits 30*a* disposed between the display screen 10 and the source printed boards 36 are collectively referred to as a source driver circuit 30. The COFs 32 on which the circuits 30*a* are disposed are disposed to connect the display screen 10 and the source printed hoards 36. The COFs 32 are connected to the display screen 10 and the source printed boards 36 by the ACF resin.

In the source driver circuit 30, each circuit 30*a* is connected to a data line 14. The circuit 30*a* supplies to the pixel 12 a voltage Vdata corresponding to a pixel signal via the data line 14. It is to be noted that a configuration of the source driver circuit 30 will be described in detail below.

The display screen 10 includes pixels 12 arranged in a matrix. Each pixel 12 is electrically connected to the scanning line 13 and the data line 14.

As illustrated in FIG. 2, the pixel 12 includes an organic EL element 15, a capacitative element 16, a drive transistor 17*a*, and switch transistors 17*b* to 17*e*. In the pixel 12, when a scanning signal scan is supplied via the scanning line 13, a voltage Vdata corresponding to a pixel signal is applied to the gate of the drive transistor 17*a* via the data line 14. As a result, a current corresponding to the pixel signal flows into the organic EL element 15, and the organic EL element 15 emits light at luminance corresponding to the pixel signal.

In more detail, the pixel 12 is connected to a reference power line Vref, an EL anode power line Vtft, an EL cathode power line Vel, an initialization power line Vini, a reference voltage control line ref, an initialization control line ini, and an enable line enb. The EL anode power line Vtft is connected to an anode voltage generating circuit (not shown) which generates an anode voltage to be applied to the organic EL element 15. The EL cathode power line Vel is connected to a cathode voltage generating circuit (not shown) which generates a cathode voltage to be applied to the organic EL element 15. It is to be noted that the EL cathode power line Vel may be connected to ground instead of the cathode voltage generating circuit. The initialization power line Vini is connected to a Vini voltage generating circuit (not shown) which generates an initial voltage Vini for initializing the capacitative element 16. With the above configuration, it is possible to stably pass a current through the organic EL element 15.

It is to be noted that the pixel 12 is not limited to the configuration illustrated in FIG. 2, and may have another configuration. The pixel 12 may include, as the minimum configuration which allows the pixel 12 to fulfill functions, at least the organic EL element 15, the capacitative element 16, the drive transistor 17*a*, and the switch transistor 17*b*.

As illustrated in FIG. 3, the source driver circuit 30 includes a receiver and decoder 40, a shift register 42, a latch circuit 44, a DA converter (voltage selector) 46, a buffer circuit 48, a switch 50, a resistor for gradation voltage generation 52, and a gradation voltage generating circuit 60.

The resistor for gradation voltage generation 52 is a so-called gamma resistor, and is divided into resistors and connected to the DA converter 46. The resistor for gradation voltage generation 52 generates a voltage corresponding to a gradation voltage by dividing a voltage applied to both ends of the resistor for gradation voltage generation 52, and outputs the voltage to the DA converter 46. Accordingly, the organic EL element 15 disposed to each pixel emits light at luminance according to each gradation.

As illustrated in FIG. 4, the gradation voltage generating circuit 60 includes a reference voltage generating unit 62 and an offset-canceling amplifier 64. The gradation voltage generating circuit 60 includes input terminals V1 and V2. In addition, the gradation voltage generating circuit 60 is connected to the resistor for gradation voltage generating 52. A voltage outputted from the gradation voltage generating circuit 60 is divided by the resistor for gradation voltage generating 52 and supplied to a voltage selector 46.

In the gradation voltage generating circuit 60, the reference voltage generating unit 62 is a so-called input resistor ladder. The reference voltage generating unit 62 generates a reference voltage in a finely divided state and highly accurately. The reference voltage generating unit 62 is connected between the external input terminals V1 and V2, and includes resistors 63 connected in series. The offset-canceling amplifier 64 is connected between each resistor 63 and between the resistor 63 and the resistor for gradation voltage generation 52.

After offset cancel, the offset-canceling amplifier 64 connects an output voltage of the offset-canceling amplifier 64 to the resistor for gradation voltage generation 52 for a brief period to generate a gradation voltage. After a certain period, an output switch is turned off to disconnect the offset-canceling amplifier 64 and the resistor for gradation voltage generation 52.

The offset-canceling amplifier 64 includes an amplifier 65, an offset capacitor 66, and switches SW1, SW2, SW3, and SW4. The offset-canceling amplifier 64 enters an offset extraction state by turning off the switches SW1 and SW2 and turning on the switches SW3 and SW4, and enters a buffer output state by turning on the switches SW1 and SW2 and turning off the switches SW3 and SW4. It is to be noted that the offset extraction state and the buffer output state will be described later.

The receiver and decoder 40, the shift register 42, the latch circuit 44, the DA converter 46, the buffer circuit 48, the switch 50, and the gradation voltage generating circuit 60 are each supplied with a corresponding control signal from a control unit (not shown). By the switch 50 being turned on with predetermined timing, the source driver circuit 30 simultaneously outputs data voltages for one row which correspond to a video signal. Accordingly, the data voltages are simultaneously supplied to respective pixels 12 in the one row of the display screen 10, and a video is displayed on the display screen 10.

It is to be noted that among control signals supplied to the source driver circuit 30 from the control unit, signals supplied to the switch 50 include a control signal for controlling a voltage to the applied to the pixel 12 in a blanking period to be described later.

Hereinafter, a method for driving the display device according to the embodiment will be described in detail.

(2. Method for Driving Display Device)

Figure 5:
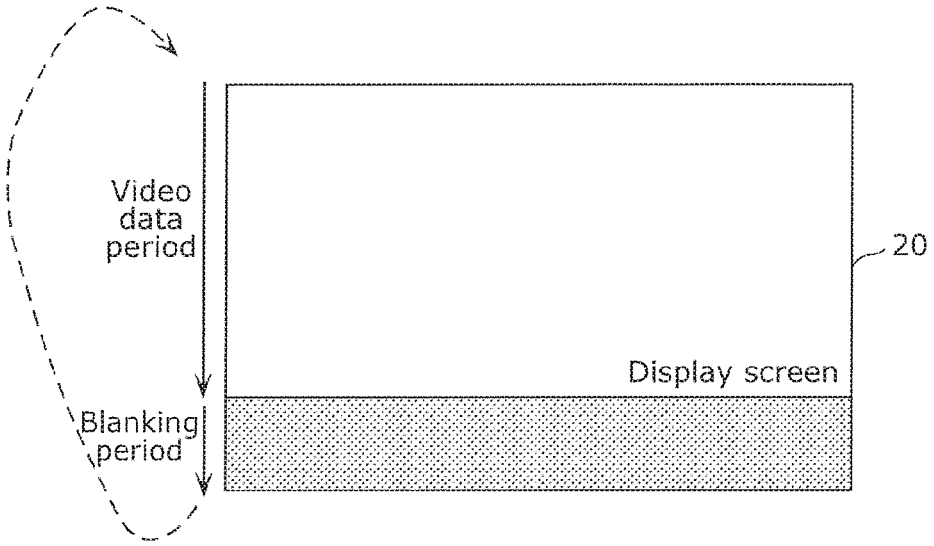
FIG. 5 is a diagram for illustrating a blanking period.
Figure 6A:
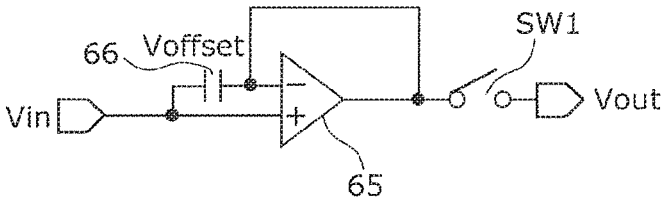
FIG. 6A is a diagram illustrating an operation of an offset-canceling amplifier.
Figure 6B:
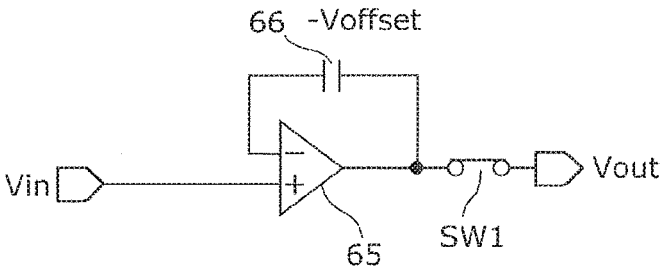
FIG. 6B is a diagram illustrating an operation of the offset-canceling amplifier.
Figure 7:
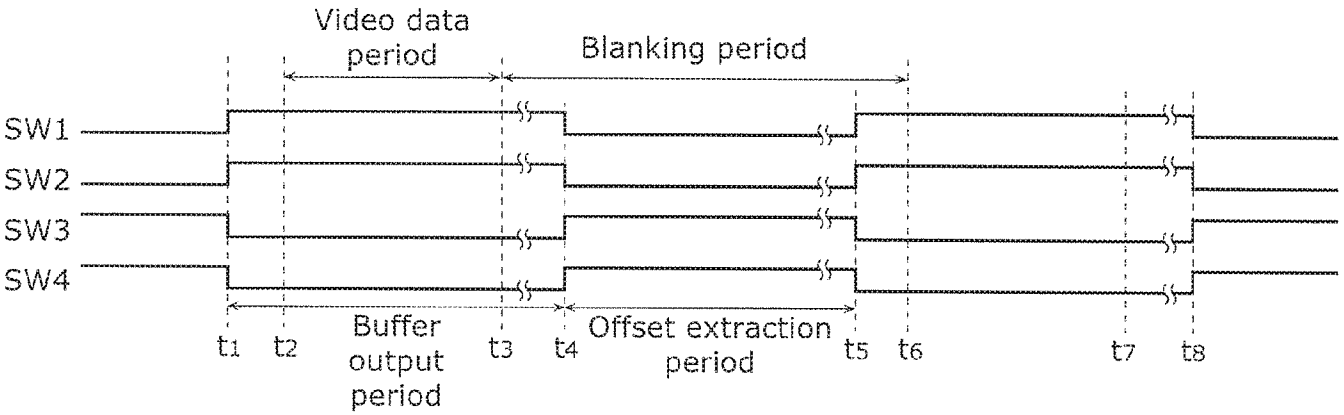
FIG. 7 is a timing diagram illustrating operations of the offset-canceling amplifier according to the embodiment.
Figure 8:
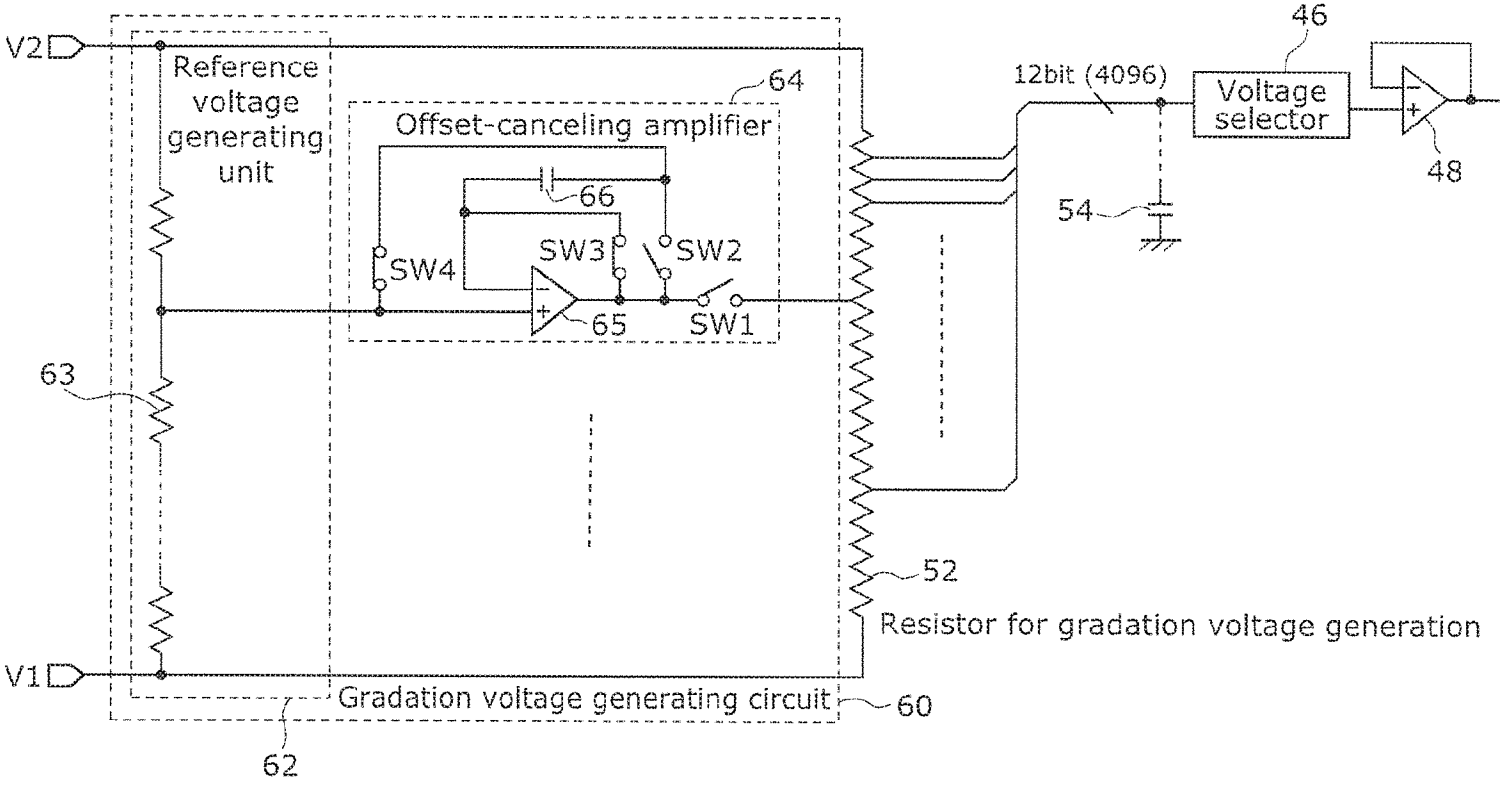
FIG. 8 is a circuit diagram illustrating a configuration of the offset-canceling amplifier in an offset extraction state.
Figure 9:
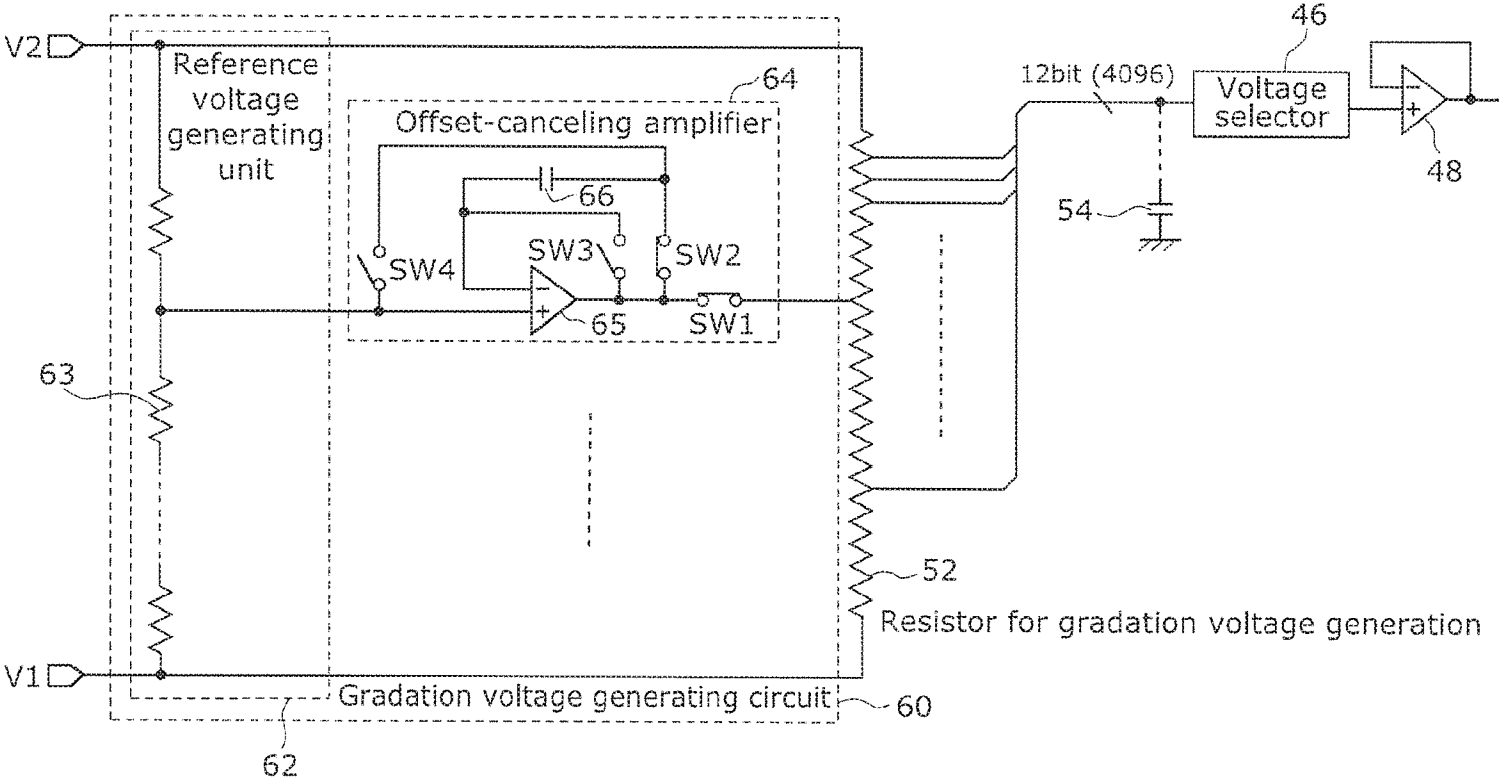
FIG. 9 is a circuit diagram illustrating a configuration of the offset-canceling amplifier in a buffer output state.

Next, the method for driving the display device will be described. FIG. 5 is a diagram for illustrating a blanking period. FIG. 6A and FIG. 6B each are a diagram illustrating an operation of an offset-canceling amplifier. FIG. 7 is a timing diagram illustrating operations of the offset-canceling amplifier according to the embodiment. FIG. 8 is a circuit diagram illustrating a configuration of the offset-canceling amplifier in an offset extraction state. FIG. 9 is a circuit diagram illustrating a configuration of the offset-canceling amplifier in a buffer output state.

The display device 1 according to the embodiment is driven by, for example, a progressive drive method for an organic EL light-emitting panel. Specifically, in the display screen 10 in which the pixels 12 are arranged in the matrix, an initialization operation, a Vth (threshold voltage) detection operation, a writing operation, and a light-emitting operation are sequentially performed row by row. In other words, from the first row to the final row of the display screen 10 are sequentially driven. This period is referred to as a video data period. In the video data period, the pixels 12 in each of the first row to the final row sequentially perform the initialization operation, the Vth detection operation, the writing operation, and the light-emitting operation.

Moreover, a period from the end of a writing period for an n-th row in a TV field (one of fields in the present invention) to the start of a writing period for the first row in the next TV field (another field in the present invention) is referred to as a blanking period.

FIG. 5 shows a virtual row, that is, a blanking row, after the final row of the display screen 10. This row corresponds to the blanking period for ensuring a time required for the circuits 30*a* to return scanning from the scan final row (the 2160th row) to a scan start row (the next first row in the TV field), and represents the blanking period with the number of scan rows corresponding to the blanking period.

In the blanking period, a voltage of a predetermined value is applied to the data line 14. For example, 0V may be applied to the data line 14.

The display device 1 repeatedly alternates between the video data period and the blanking period. Moreover, in connection with this, the offset-canceling amplifier 64 repeatedly alternates between the buffer output state and the offset extraction state.

As illustrated in FIG. 6A, the offset-canceling amplifier 64 in the offset extraction state has a circuit configuration in which the offset capacitor 66 is connected between an input terminal and the amplifier 65. Consequently, Vin+Voffset obtained by adding capacitance Voffset of the offset capacitor 66 to an input voltage Vin is outputted as an output voltage Vout from the output terminal of the offset-canceling amplifier 64 in the offset extraction state.

Moreover, as illustrated in FIG. 6B, the offset-canceling amplifier 64 in the buffer output state has a circuit configuration in which the offset capacitor 66 is connected between the amplifier 65 and the output terminal. Consequently, in the offset-canceling amplifier 64 in the buffer output state, capacitance of the offset capacitor 66 is represented as −Voffset. Accordingly, Vin+Voffset−Voffset=Vin obtained by further adding −Voffset to the Vout shown in FIG. 6A is outputted as an output voltage Vout from the output terminal of the offset-canceling amplifier 64. Since the switches SW1 to SW4 are switched after electrical charges corresponding to an offset voltage are temporarily accumulated in the offset capacitor 66, it is possible to output a gradation voltage with high accuracy and stability when the offset extraction state and the buffer output state are switched.

FIG. 7 is a timing diagram illustrating operations of the offset-canceling amplifier 64. It is to be noted that in FIG. 7, a period in which the offset-canceling amplifier 64 enters the buffer output state is referred to as the buffer output period, and a period in which the offset-canceling amplifier 64 enters the offset extraction state is referred to as the offset extraction period. Moreover, the switches SW1 to SW4 are closed when a signal level is Low, and are opened when a signal level is High.

As illustrated in FIG. 7, when the switches SW1 and SW2 are opened and the switches SW3 and SW4 are closed at a predetermined time t1 in the blanking period, the offset-canceling amplifier 64 transitions from the offset extraction state to the buffer output state as illustrated in FIG. 8. Consequently, Vin+Voffse−Voffset=Vin is outputted as an output voltage Vout from the output terminal of the offset-canceling amplifier 64 in the offset extraction state.

Next, the blanking period is ended and the video data period is started at a time t2. In other words, the pixels 12 in each of the first row to the final row perform the initialization operation, the Vth detection operation, the writing operation, and the light-emitting operation in listed order, and video data is displayed on the display screen 10.

Furthermore, the video data period is ended and the blanking period is started at a time t3. At this time the offset-canceling amplifier 64 is still in the buffer output state, and Vin+Voffse−Voffset=Vin is outputted as the output voltage Vout from the output terminal of the offset-canceling amplifier 64.

Next, when the switches SW1 and SW2 are closed and the switches SW3 and SW4 are opened at a time t4, the offset-canceling amplifier 64 transitions from the buffer output state to the offset extraction state as illustrated in FIG. 9. As a result, electrical charges corresponding to an offset voltage of the amplifier 65 are accumulated in the offset capacitor 66. Accordingly, Vin+Voffset is outputted as the output voltage Vout from the output terminal of the offset-canceling amplifier 64 in the offset extraction state.

When the electrical charges corresponding to the offset voltage of the amplifier 65 are accumulated in the offset capacitor 66, at a time t5, the switches SW1 and SW2 are opened again, the switches SW3 and SW4 are closed again, and the offset-canceling amplifier 64 transitions from the offset extraction state to the buffer output state as illustrated in FIG. 8. Consequently, Vin+Voffse−Voffset=Vin is outputted as the output voltage Vout from the output terminal of the offset-canceling amplifier 64 in the offset extraction state. It is to be noted that the time t5 is within the blanking period.

Subsequently, the same operations as the times t2, t3, and t4 are repeated at times t6, t7, and t8.

As stated above, the source driver circuit 30 according to the embodiment includes the reference voltage generating unit 62 in an input stage of the amplifier, and causes the reference voltage generating unit 62 to generate a reference voltage in a finely divided state and highly accurately. Moreover, the resistor for gradation voltage generation 52 performs offset cancel in the blanking period. After the offset cancel, by the switch SW1 being turned on, an amplifier output voltage is connected to the reference voltage generating unit 62 for a brief period to generate a gradation voltage. After a certain period, the switch SW1 is turned off to disconnect the offset-canceling amplifier 64 and the resistor for gradation voltage generation 52.

With the above configuration, no switching noise occurs in the gradation voltage generating circuit 60 and the resistor for gradation voltage generation 52 when a gradation is switched. Consequently, it is possible to output the gradation voltage with high accuracy and stability.

As above, the source driver circuit according to the embodiment makes it possible to generate the gradation voltage with high accuracy, at high speed, and with stability.

It is to be noted that although the aforementioned source driver circuit 30 includes the offset-canceling amplifier 64, the amplifier 65, and the offset capacitor 66, the source driver circuit 30 need not include, among these components, the offset-canceling amplifier 64 and the offset capacitor 66.

Other Embodiments

Although the display device according to the embodiment has been described above, the display device is not limited to the aforementioned embodiment. Modifications that can be obtained by executing various modifications to the aforementioned embodiment that are conceivable to a person skilled in the art without departing from the essence of the present invention, and various devices internally equipped with the display device are included in the present invention.

For example, although the switches SW1, SW2, SW3, and SW4 are switched with the same timing in the aforementioned embodiment, the switches SW1, SW2, SW3, and SW4 need not always be switched with the same timing, and may be sequentially switched.

Moreover, the offset-canceling amplifier is not limited to the above configuration, and may have any other configuration. For example, a pair of the offset-canceling amplifiers may be connected between the reference voltage generating units and between the reference voltage generating units and the resistor for the gradation voltage generation.

Figure 10:
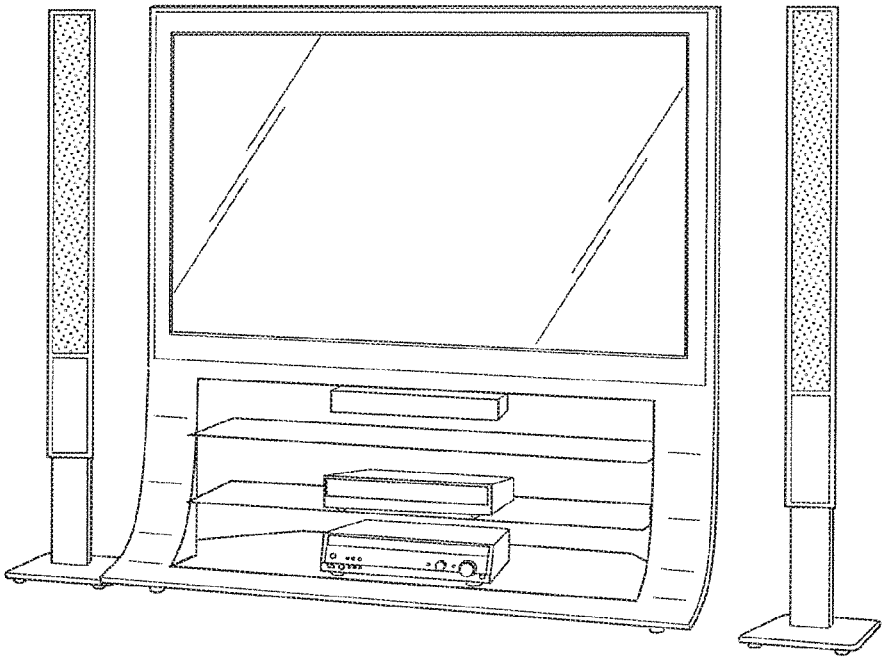
FIG. 10 is an external view of a flat-panel TV including the display device according to the embodiment.

Moreover, forms obtained by various modifications to the aforementioned embodiment that are conceivable to a person skilled in the art as well as forms realized by combining structural components in different embodiments are included in the scope of the present invention. For example, the present invention includes a flat-panel television system including the source driver circuit according to the present invention as illustrated in FIG. 10.

INDUSTRIAL APPLICABILITY

The present invention is useful, particularly, for technical fields of displays of flat-panel televisions and personal computers which are required to have large screens and a high resolution.

REFERENCE SIGNS LIST

1. display device
10 display screen
12 pixel
13 scanning line
14 data line
15 organic EL element
16 capacitative element

17*a* drive transistor
17*b*, 17*c*, 17*d*, 17*e* switch transistor
20 gate driver circuit
20*a*, 30*a* circuit
22, 32 COF
26 gate printed board
30 source driver circuit
36 source printed board
40 receiver and decoder
42 shift register
44 latch circuit
46 DA converter (voltage selector)
48 buffer circuit
50 switch
52 resistor for gradation voltage generation (gamma resistor)
54 parasitic capacitance
60 gradation voltage generating circuit
62 reference voltage generating unit
64 offset-canceling amplifier
65 amplifier
66 offset capacitor
SW1, SW2, SW3, SW4 switch

The invention claimed is:

1. A source driver circuit that supplies, to each of pixels arranged in a matrix, an electrical signal corresponding to a pixel signal, the source driver circuit comprising:

a reference voltage generator, which includes a plurality of resistors connected in series;

a resistor for gradation voltage generation which divides an input voltage into voltages of magnitudes; and a gradation voltage generating circuit, which is connected between the plurality of resistors and is also connected between the plurality of resistors and the resistor for gradation voltage generation, that includes an offset-canceling amplifier, wherein the offset-canceling amplifier includes an amplifier, an offset capacitor, and a switch in series with an output of the amplifier, and wherein the offset-canceling amplifier alternates between an offset extraction state, in which the switch is open and an offset voltage of the offset-canceling amplifier is extracted, and a buffer output state, in which the switch is closed and the offset voltage is added to the pixel signal and outputted.

2. The source driver circuit according to claim 1, wherein in the offset extraction state, an electrical charge corresponding to the offset voltage of the amplifier is accumulated in the offset capacitor, and in the buffer output state, a voltage corresponding to the electrical charge accumulated in the offset capacitor is added to the pixel signal and outputted.

3. The source driver circuit according to claim 1, wherein the pixels each include a light-emitting element, and the light-emitting element is an organic electroluminescent (EL) element.

4. The source driver circuit according to claim 1, wherein the offset-canceling amplifier enters the offset extraction state in a blanking period after an end of a video data period in which video data is displayed on a display screen, and enters the buffer output state after the offset voltage is accumulated as the electrical charge in the offset capacitor in the blanking period.

5. A display device, comprising:

the source driver circuit according to claim 1.

* * * * *